US010500511B2

(12) United States Patent
Muraki et al.

(10) Patent No.: US 10,500,511 B2
(45) **Date of Patent: *Dec. 10, 2019**

(54) SPINNING TOP TOY

(71) Applicant: TOMY COMPANY, LTD., Katsushika-ku, Tokyo (JP)

(72) Inventors: Makoto Muraki, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/216,069

(22) Filed: Dec. 11, 2018

(65) Prior Publication Data

US 2019/0105576 A1 Apr. 11, 2019

Related U.S. Application Data

(63) Continuation of application No. 14/768,882, filed as application No. PCT/JP2015/061797 on Apr. 17, 2015, now Pat. No. 10,183,226.

(30) Foreign Application Priority Data

Mar. 27, 2015 (JP) ..... 2015-067294

(51) Int. Cl.
*A63H 33/00* (2006.01)
*A63H 1/02* (2006.01)

(52) U.S. Cl.
CPC ..... *A63H 1/02* (2013.01)

(58) Field of Classification Search
CPC ... A63H 1/00; A63H 1/02; A63H 1/18; A63H 1/26

(Continued)

(56) References Cited

U.S. PATENT DOCUMENTS 2,619,769 A 12/1952 Gallaher
3,201,896 A 8/1965 Dalhart (Continued)

FOREIGN PATENT DOCUMENTS

JP 61-51889 4/1986
JP 9-38337 2/1997

(Continued)

OTHER PUBLICATIONS

English abstract for Japanese Patent Publication No. 61-51889, dated on Apr. 8, 1986.

(Continued)

*Primary Examiner* — Joseph B Baldori
(74) *Attorney, Agent, or Firm* — Staas & Hasley LLP

(57) ABSTRACT

A spinning top toy including a body and a separate shaft portion. The body has a first hook and the shaft portion has a second hook. The body and the shaft portion are switchable between couplable and decouplable states depending on a relative rotational position. The first hook and the second hook are vertically aligned in the couplable state, and are vertically misaligned in the decouplable state. An urging unit brings an upper face of the first hook and a bottom face of the second hook into contact by an urging force of a spring in the couplable state. The body and the shaft portion enter the couplable state by turning and pushing. The body and the shaft portion engage each other by bringing the upper face of the first hook into contact with the bottom face of the second hook by the urging force of the spring.

7 Claims, 5 Drawing Sheets

(58) Field of Classification Search
USPC ..... 446/4, 256, 257, 263
See application file for complete search history.

(56) References Cited

U.S. PATENT DOCUMENTS

| | | | |
|---|---|---|---|
| 3,564,756 | A | 2/1971 | Yokoi |
| 4,772,241 | A | 9/1988 | Bro et al. |
| 5,941,753 | A | 8/1999 | Diresta |
| 6,626,729 | B2 | 9/2003 | Osawa |
| 6,769,953 | B1 | 8/2004 | Sutton et al. |
| 6,776,680 | B2 | 8/2004 | Chow |
| 9,101,845 | B2 | 8/2015 | Cai |
| 2009/0253344 | A1 | 10/2009 | Ujita et al. |
| 2014/0302743 | A1 | 10/2014 | Cai |
| 2014/0378024 | A1 | 12/2014 | Choi |
| 2016/0228777 | A1 | 8/2016 | Cai |

FOREIGN PATENT DOCUMENTS

| | | |
|---|---|---|
| JP | 3067318 | 3/2000 |
| JP | 3071812 | 9/2000 |
| JP | 2003-62354 | 3/2003 |
| JP | 3109118 | 5/2005 |
| JP | 2005-328976 | 12/2005 |
| JP | 3170034 | 9/2011 |
| JP | 2014-533594 | 12/2014 |

OTHER PUBLICATIONS

Japanese Platform for Patent Information English abstract for Japanese Patent Publication No. 2003-062354, dated Mar. 4, 2003.
Japanese Platform for Patent Information English abstract for Japanese Patent Publication No. 2005-328976, dated Dec. 2, 2005.
English abstract of PCT Publication No. WO 2013/078896 A1, dated Jun. 6, 2013, corresponding to JP 2014-533594.
Japanese Office Action dated May 26, 2015 in corresponding Japanese Patent Application No. 2015-067294.
International Search Report dated May 27, 2015 in corresponding International Patent Application No. PCT/JP2015/061797.
Written Opinion of International Search Report dated May 27, 2015 in corresponding International Patent Application No. PCT/JP2015/061797.
PCT Written Opinion of the International Searching Authority dated Dec. 11, 2015 in corresponding International Patent Application No. PCT/JP2015/061797.
Extended European Search Report dated Feb. 23, 2018 in corresponding European Patent Application No. 15745357.2.
Office Action for U.S. Appl. No. 14/768,882, dated Oct. 6, 2016.
Office Action for U.S. Appl. No. 14/768,882, dated Dec. 27, 2016.
Advisory Action for U.S. Appl. No. 14/768,882, dated Mar. 24, 2017.
Office Action for U.S. Appl. No. 14/768,882, dated Jun. 2, 2017.
Office Action for U.S. Appl. No. 14/768,882, dated Sep. 13, 2017.
Office Action for U.S. Appl. No. 14/768,882, dated Apr. 6, 2018.
Notice of Allowance for U.S. Appl. No. 14/768,882, dated Sep. 19, 2018.
U.S. Appl. No. 14/768,882, filed Aug. 19, 2015, Makoto Muraki, Tomy Company, Ltd.

SPINNING TOP TOY

CROSS REFERENCE TO RELATED APPLICATIONS

This application is a continuation of U.S. patent application Ser. No. 14/768,882, filed Aug. 19, 2015, which is based upon and claims the benefit under 35 U.S.C. § 371 of PCT/JP2015/061797, filed Apr. 17, 2015, which claims foreign priority benefit of Japanese Application No. 2015-067294, filed Mar. 27, 2015, the contents of which are incorporated herein by reference.

TECHNICAL FIELD

The present invention relates to a spinning top toy.

BACKGROUND ART

Some known battle games involving spinning top toys determine win and loss of the games by launching spinning top toys into each other such that the impact force knocks out the spinning top toys of the opponents or causes ejectable components on the bodies of the spinning top toys to pop off (for example, refer to Patent Documents 1 and 2).

The spinning top toys described in Patent Documents 1 and 2 each include an ejectable component and a body (top body) which are engaged with a resilient member. The impact force generated by a collision of the spinning top toys disengages the ejectable component from the body, and the ejectable component is ejected upward by the urging force of the resilient member.

PRIOR ART DOCUMENTS

Patent Document 1: Japanese Patent Application Laid-Open No. H9-38337

Patent Document 2: Registered Utility Model No. 3109118

The spinning top toys (top bodies) described in Patent Documents 1 and 2 have structures in which each component cannot be readily disassembled. Thus, the spinning top toys cannot be readily customized to achieve desired designs or performances of the spinning top toys.

This is true for not only spinning top toys for battle games but also general spinning top toys including fixed bodies and shafts.

SUMMARY OF THE INVENTION

An object of the present invention, which has been conceived in light of the issues described above, is to provide a spinning top toy that can be readily assembled or disassembled.

The spinning top toy has a predetermined rotational direction, and includes:

a body, and a shaft portion, wherein the body and the shaft portion are separate pieces, wherein the body has a third projection or hook and the shaft portion has a second projection or hook, the body and the shaft portion being switchable between a couplable state and a decouplable state depending on a relative rotational position around the axis of the shaft portion, the first hook and the second hook being vertically aligned in the couplable state, the first hook and the second hook being vertically misaligned in the decouplable state, wherein an upper face of the first hook and a bottom face of the second hook come into contact by an urging force of a spring in the couplable state, and wherein the body and the shaft portion enter the couplable state by turning the shaft portion in the decouplable state against the urging force of the spring in a direction opposite to the predetermined rotational direction relative to the body, and the body and the shaft portion engage each other by bringing the upper face of the first hook into contact with the bottom face of the second hook by the urging force of the spring.

The spinning top toy can further include:

an adjuster ring that varies the performance of the spinning top toy, the adjuster ring being disposed between the body and the shaft portion in a coupled state of the body and the shaft portion.

The adjuster ring can include a fly wheel.

The adjuster ring and the shaft portion can be configured to vertically fit when at predetermined rotational positions relative to each other around the axis of the shaft portion and turn together between the decouplable state and the couplable state.

The body can have an arcuate slit and the adjuster ring can have a tongue protruding upward to be disposed in the arcuate slit from below so that the rotation of the adjuster ring can be limited relative to the body.

The tongue can be positioned at one end of the arcuate slit in the decouplable state, and the tongue can be positioned at an opposite end of the arcuate slit in the couplable state.

Opposing surfaces of the body and the shaft portion can have resistors that achieve stepwise control of the rotation of the shaft portion relative to the body from the couplable state to the decouplable state.

The resistors can include a plurality of depressions or projections disposed along the circumferential direction on one of the opposing surfaces and at least one of the other of the depressions and projections on the other opposing surface, the depressions and projections being capable of fitting to each other.

The shaft portion separated from the body is brought close to the body and is turned in a predetermined direction relative to the body so as to couple the body and the shaft. In contrast, the shaft coupled with the body is turned in a direction opposite to the predetermined direction relative to the body so as to separate the body and the shaft. Thus, the spinning top toy can be readily assembled or disassembled.

The adjuster ring, which can vary the performance of the toy, is simply disposed between the body and the shaft in the coupled state of the body and the shaft, and thus can be readily attached or detached.

The adjuster ring can be a fly wheel so that the spinning top toy can stably spin for a long time.

Conventional spinning top toys include integrated units of relatively heavy flywheels and bodies. Thus, such spinning top toys have an advantage in "battles" because they include the heave fly wheels, which strike and apply large forces to the spinning top toys of the opponents and spin for a long time. The spinning top toy according to the third means also has such an advantage. In a battle game involving the spinning top toy according to an embodiment of the present invention, the relatively heavy flywheel and the shaft continue to spin after the body is attacked by a top of an opponent, while the body, which is lighter than the fly wheel, is readily affected by an external force (for example, an impact force generated through collision with a spinning top toy of the opponent or friction generated between two spinning top toys). The effect on the body increases as the weight of the fly wheel increases, and thus causes ready decoupling of the body and the shaft. Accordingly, competitiveness and strategic thinking are promoted.

The adjuster ring and the shaft can be vertically fit to each other at a predetermined relative rotational position, and thus they can be readily aligned.

Turning of the adjuster ring relative to the body is limited so that relative positioning is facilitated.

The tongue can be disposed at one end of an arcuate slit in a decouplable state, and the tongue can be disposed at the other end of the arcuate slit in a couplable state, facilitating relative positioning.

The body and the shaft are not separated by a single strike applying an impact force to the body in a battle game. Thus, the players can enjoy playing the battle game for a long time.

DESCRIPTION OF EMBODIMENTS

Embodiments of a spinning top toy according to the present invention will be described now with reference to the accompanying drawings.

Overall Configuration

Figure 1:
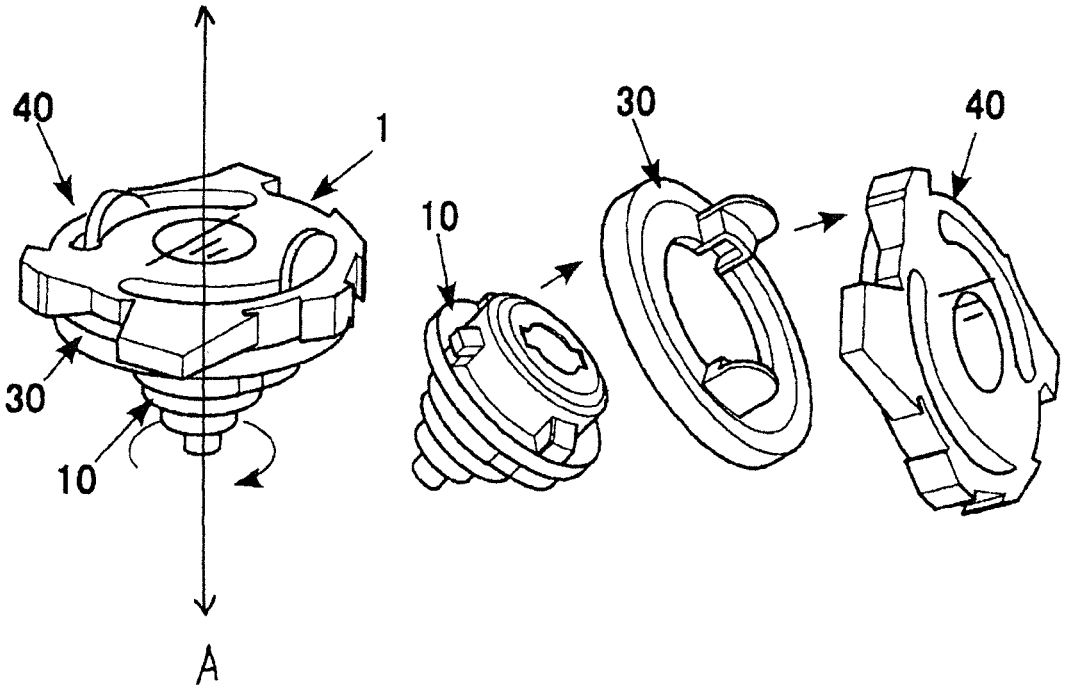
FIG. 1 illustrates a spinning top toy according to an embodiment of the present invention in use.
Figure 2:
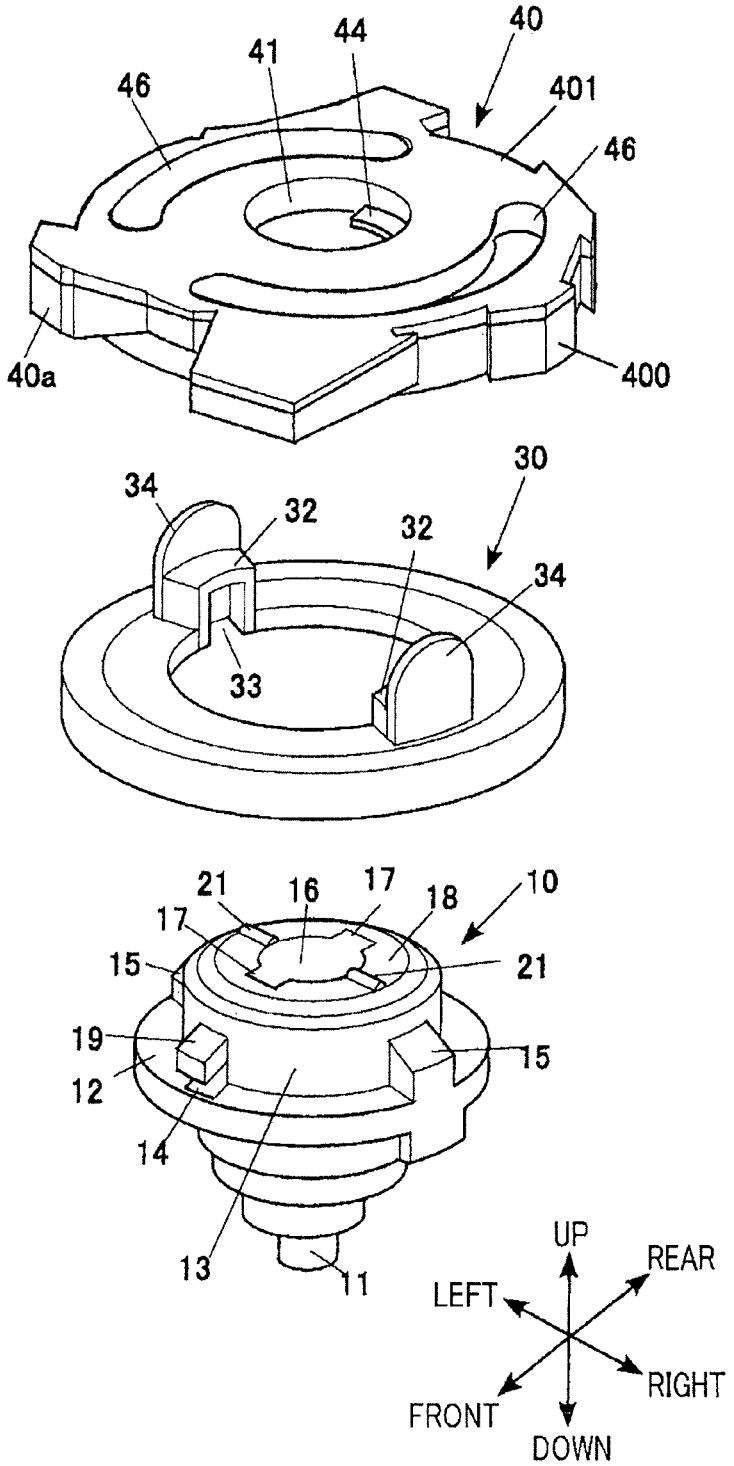
FIG. 2 is an exploded perspective view of the spinning top toy according to the embodiment.
Figure 3:
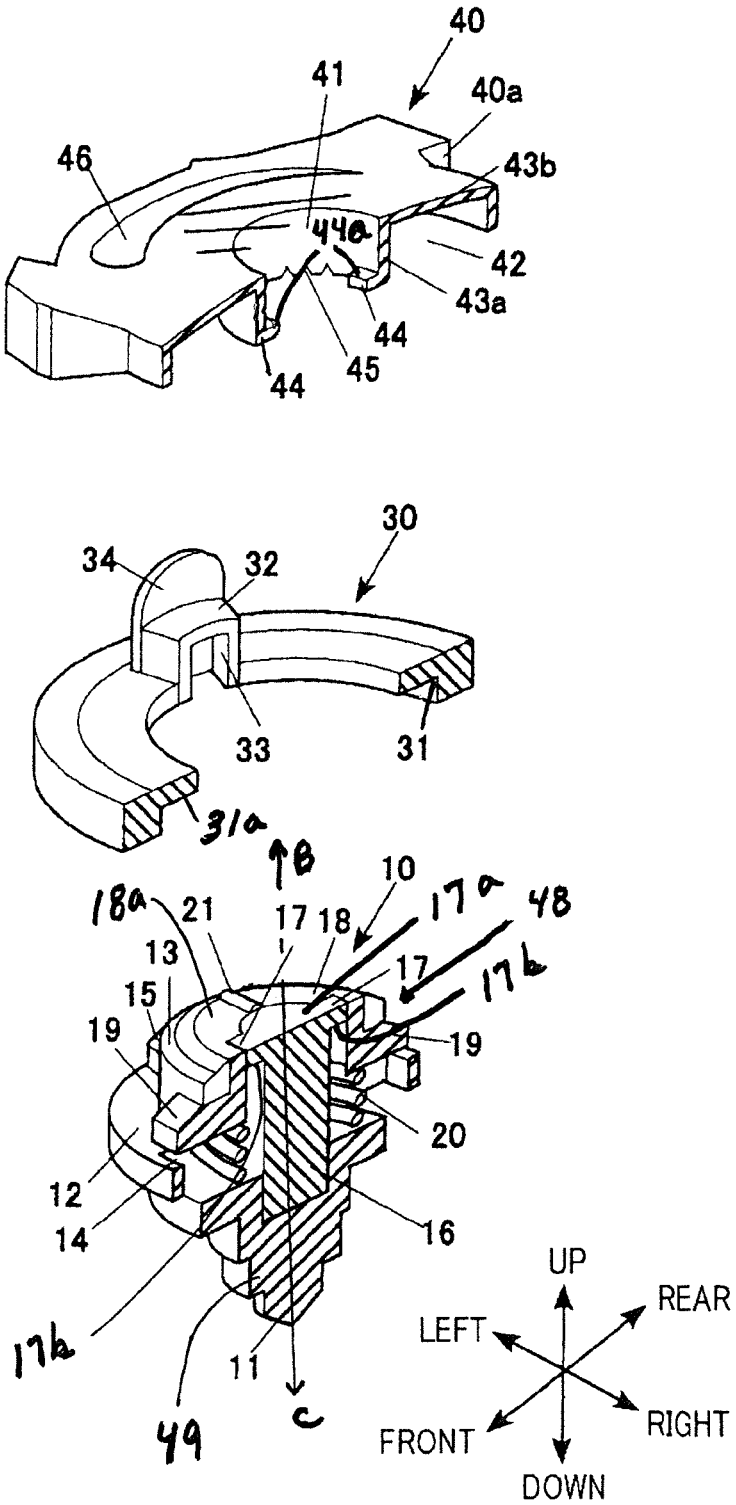
FIG. 3 is an exploded cross-sectional perspective view of the spinning top toy according to the embodiment.

FIG. 1 illustrates a spinning top toy according to an embodiment of the present invention in action. FIG. 2 is an exploded perspective view of the spinning top toy according to this embodiment. FIG. 3 is an exploded cross-sectional perspective view of the spinning top toy according to this embodiment. In this specification, the terms "up," "down," "left," "right," "front," and "back" refer to the corresponding directions in FIGS. 2 and 3.

A spinning top toy 1 according to this embodiment can be used in "spinning top battle games." Specifically, the spinning top toy 1 can be used in a battle game in which the spinning top toy of the winner collides with and dissembles a spinning top toy 1 of an opponent by the impact force, as illustrated on the right of FIG. 1.

With reference to FIGS. 1-3, the spinning top toy 1 includes an axis of rotation "A," a shaft portion 10 constituting a lower segment, and an adjuster ring 30 and a body 40, which together constitute an upper segment.

Detailed Configuration

1. Shaft Portion 10

The shaft portion 10 includes a rotary shaft 11 at a lower portion 49 thereof, a flange 12 in a middle portion, and a cylinder 13 in an upper portion 48. The rotary shaft 11, the flange 12, and the outer cylindrical segment 13 are composed of synthetic resin. Alternatively, any material other than synthetic resin may be selected; for example, one or more of the rotary shaft 11, the flange 12, and the outer cylindrical segment 13 may be composed of metal.

The lower portion of the flange 12 has a substantial shape of an inverted cone outlined by steps leading from the flange 12 to the outer circumference of the rotary shaft 11.

With reference to FIG. 2, holes 14 are provided in the flange 12 and the cylinder 13 at two positions opposite to each other in the front and back direction across the axis of the rotary shaft 11. The outer cylindrical segment 13 and the lower portions of flange 12 have first projections 15 at two positions opposite to each other in the left and right direction across the axis of the rotary shaft 11. The outer surfaces of the first projections, 15 are flush with the outer circumferential surface of the flange 12.

With reference to FIG. 3, a fixed inner segment, i.e., a column, 16 is vertically disposed inside an outer cylindrical segment 13. The upper surface of the column 16 may be disposed at any position, for example, above the upper surface of the outer cylindrical segment 13. An upper end 17*a* of the column 16 has second projections or hooks (first hooks) 17 (having flat lower surfaces 17*b*)projecting radially outward from two positions opposite to each other in the front and back direction across the axis of the rotary shaft 11.

The shaft portion 10 includes a segment that is movable relative to the fixed inner segment or column 16 of the shaft portion 10, i.e., a movable cylindrical segment, 18 which is disposed inside the outer cylindrical segment 13 and which surrounds the upper region of the outer circumference of the column 16. The lower region of the outer circumferential surface of the movable segment 18 has projections 19 projecting radially outward from two positions opposite to each other in the front and back direction across the axis of the rotary shaft 11. With reference to FIG. 3, the projections 19 fit into the holes 14. The movable segment 18 can move vertically, but the upward movement is restricted by the upper edges of the holes 14. The movable segment 18 is urged upward by a coil spring 20 wound around the column 16. Normally, the projections 19 are in contact with the upper edges of the holes 14, and the upper surface of the movable segment 18 is flush with the upper end 17*a* of the cylinder 13.

An upper surface 18*a* of the movable segment 18 has radially extending linear projections 21 at two positions opposite to each other in the left and right direction across the axis of the rotary shaft 11.

2. Adjuster Ring 30

According to this embodiment, the adjuster ring 30 is a fly wheel. This adjuster ring 30 is a plate ring. An annular step 31 is provided on a bottom surface 31*a* of the adjuster ring 30 for receiving the flange 12 of the shaft 10 inserted from below. An upper surface of the adjuster ring 30 has second protrusions 32 extending upward from two positions opposite to each other in the left and right direction across the axis of the rotary shaft 11. First depressions 33 are provided below the second protrusions 32 for receiving the first projection 15 of the shaft portion 10 inserted from below. The upper surface of the adjuster ring 30 has tongues 34 adjoining outer faces of the second protrusions 32 and extending upward. The tongues 34 protrude above the second protrusions 32.

Instead of the body 40 described below, the adjuster ring 30 may be the one that has an uneven profile with protrusions on the outer circumferential surface for an effective attack on a spinning top toy 1 of an opponent or the one that has depressions on the outer circumferential surface for defense against an attack by a spinning top toy 1 of an opponent. Such protrusions or depressions may be integrated with the fly wheel.

3. Body 40

The body 40 has a discoidal shape. With reference to FIG. 2, the body 40 includes a base 400 and a transparent cover 401 covering the base 400 and having a shape substantially identical to that of the base 400 in top view.

Uneven profile 40*a* is formed on the outer circumference of the body 40. A circular hole 41 is provided at the center of the base 400. The circular hole 41 is covered with the transparent cover 401 from above. The bottom surface of the body 40 has an annular second depression 42 for receiving the second protrusions 32 of the adjuster ring 30 inserted from below.

The inner circumferential wall 43a defining the annular depression 42 has third projections or hooks (second hooks) 44 (with flat upper surfaces 44*a*) at the bottom edge projecting radially inward from two positions opposite to each other in the front and back direction across the axis of the rotary shaft 11. The bottom edge of the inner circumferential wall 43*a* has radially extending linear first recesses 45 provided at a predetermined pitch along the circumference in two regions opposite to each other in the left and right direction across the axis of the rotary shaft 11.

A ceiling 43*b* defining the second annular depression 42 of the body 40 has arcuate slits 46 through which the tongues 34 of the adjuster ring 30 are inserted from below. The arcuate slits 46 are long enough for the tongues 34 to move therein.

Assembly

An example of the assembly of the spinning top toy 1 will now be described.

Figure 4A:
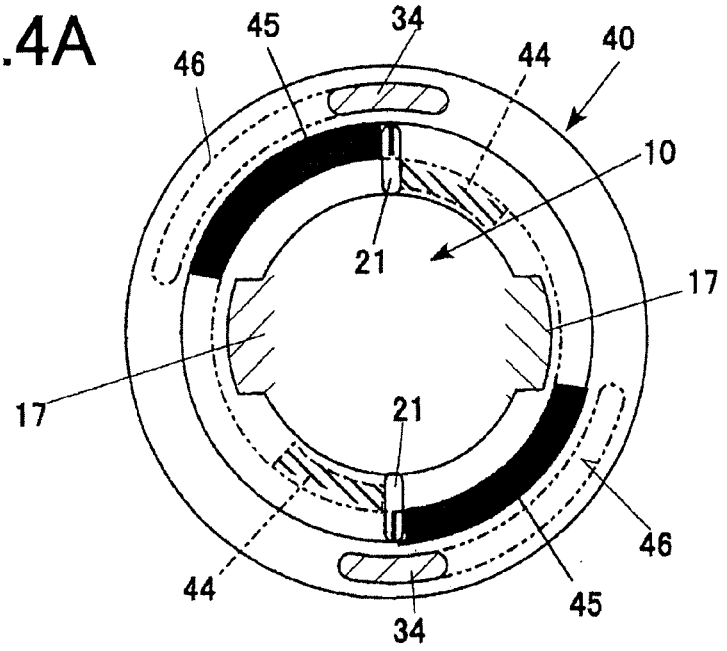
FIG. 4A illustrates a decouplable state of a shaft portion, a body, and a flywheel of the spinning top toy according to the embodiment.
Figure 4B:
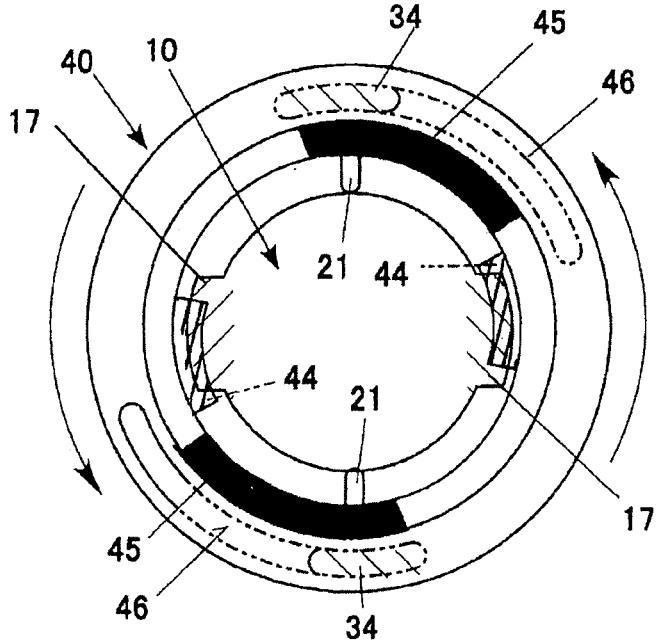
FIG. 4B illustrates a couplable state of the shaft portion, the body, and the flywheel of the spinning top toy according to the embodiment.

The first projection 15 of the shaft portion 10 are aligned to the first depressions 33 of the adjuster ring 30 from below, and the shaft portion 10 is fit to the adjuster ring 30. This assembly is aligned with the body 40 from below. The tongues 34 of the adjuster ring 30 of the assembly are aligned to predetermined ends of the arcuate slits 46 of the body 40 (FIG. 4A). In this state, the second projections 17 of the shaft portion 10 and the third projections 44 of the body 40 are not vertically aligned. This state is referred to as a decouplable state. Subsequently, the shaft portion 10 of the assembly is urged toward the body 40. As a result, the adjuster ring 30 is pushed against the bottom surface of the body 40. Urging of the shaft portion 10 of the assembly toward the body 40 causes the bottom surface of the adjuster ring 30 to push the projections 19 of the shaft portion 10 downward in direction of "C" of FIG. 3 against the urging force of the coil spring 20. In this state, the second projections 17 of the shaft portion 10 are biased above the third projections 44 of the body 40. The shaft portion 10 is turned together with the adjuster ring 30 relative to the body 40 until the tongues 34 move to the ends opposite to the predetermined ends (FIG. 4B). The adjuster ring 30 and the shaft portion 10 are turned relative to the body 40. FIG. 4B illustrates the body 40 turned relative to the shaft portion 10 and the adjuster ring 30. This vertically aligns the second projections 17 of the shaft portion 10 and the third projections 44 of the body 40. This state is referred to as a couplable state. Releasing the hand of the user from the shaft portion 10 causes the flat lower surfaces 17 of the second projections 17 to come into contact with the flat upper surfaces 44*a* of the third projections 44 of the body 40 by the urging force of the coil spring 20, and the shaft portion 10, the adjuster ring 30, and the body 40 to couple to each other, so as to assemble the spinning top toy 1.

How to Play

An example of how to play with the spinning top toy 1 will now be described.

In this example, a spinning top toy 1 engages in a "battle" with another spinning top toy 1.

Figure 5:
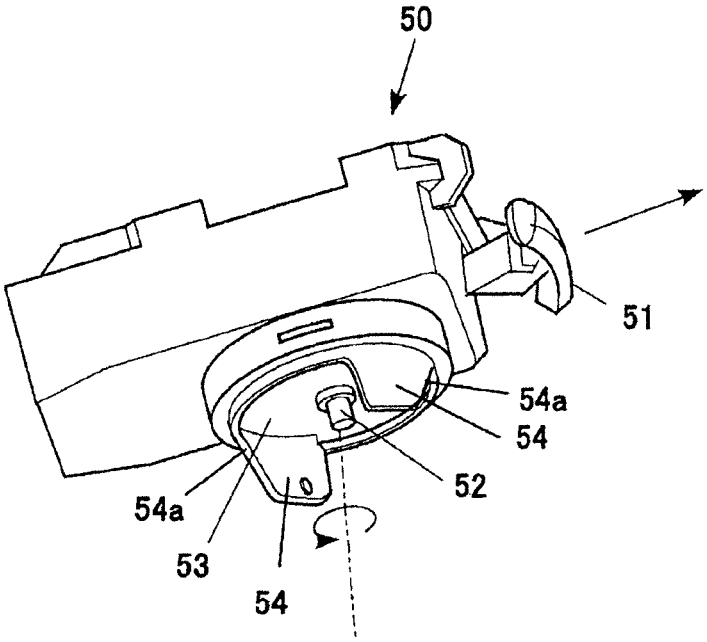
FIG. 5 is a perspective view of an example launcher that rotationally drives the spinning top toy according to the embodiment.

The rotational force of the spinning top toy 1 is generated with a launcher 50, such as that illustrated in FIG. 5. The launcher 50 includes an internal disk (not shown). The disk is urged in a first rotational direction by a spiral spring (not shown). A handle 51 is then pulled to pull a string (not shown) wound around the disk so as to spin the disk, thereby spinning a top holder 53. The spinning of the top holder 53 is transmitted to the spinning top toy 1 through forks 54 protruding downward so as to spin the spinning top toy 1. The forks 54 are inserted into the arcuate slits 46 of the body 40. Fully pulling the handle 51 of the launcher 50 stops the spinning of the disk and thus the spinning of the top holder 53, but the spinning top toy 1 continues to spin due to inertia. The spinning top toy 1 follows the tilting faces 54*a* of the forks 54, respectively, and detaches from the top holder 53. In FIG. 5, reference numeral 52 denotes a rod that can hide in the top holder 53. When the spinning top toy 1 is mounted on the top holder 53, the rod 52 is pushed into the top holder 53 by the upper surface of the spinning top toy 1. The rod 52 detects the attachment or detachment of the spinning top toy 1, for example.

The spinning top toy 1 launched in this way spins in a predetermined field and collides with another spinning top toy 1 of an opponent. The impact force and friction generated by the collision generate a reactive force at the body 40 in a direction opposite to the rotational direction of the shaft portion 10 (in direction "B" shown in FIG. 3) and the adjuster ring 30, as illustrated in FIG. 4B. This causes the body 40 to spin in an opposite direction relative to the rotational direction of the shaft portion 10 and the adjuster ring 30.

This spinning causes each of the linear first recesses 45 of the body 40 to engage the corresponding linear projections 21 of the shaft portion 10 one by one for positioning. At the position illustrated in FIG. 4A, the third projections 44 of the body 40 detach from the second projections 17 of the shaft portion 10, and the body 40 moves away from the shaft portion 10 by the urging force of the coil spring 20. This dissembles the spinning top toy 1 as illustrated in the right of FIG. 1.

Modifications of Embodiment of Present Invention

The present invention should not be limited to the embodiment described above and may be modified in various ways without departing from the scope of the invention.

In the embodiment described above, the linear third projections 21 of the shaft portion 10 and the linear depressions 45 of the body 40 are provided as rotation resistors between the shaft portion 10 and the body 40. Alternatively, for example, projections and depressions, respectively, having other shapes may be provided. The number of projections and depressions should not be limited to that according to the embodiment described above. The rotation resistors may be composed of rubber and disposed on the opposing surfaces of the shaft portion 10 and the body 40, for example. In such a case, the shaft portion 10 and the body 40 spin relative to each other by an external impact force so as to gradually disengage from each other.

In the embodiment described above, the spinning top toy 1 spins clockwise in top view. Alternatively, the spinning top toy 1 may spin counterclockwise in top view. In such a case, the shaft portion 10 and the adjuster ring 30 which are the same as above can be used while the body 40 is replaced with a different one so as to readily assemble a spinning top toy 1 in which the body 40 spins counterclockwise in top view relative to the shaft portion 10 and the adjuster ring 30.

In the embodiment described above, a battle game involving spinning top toys 1 and 1 that spin clockwise in top view is described. Alternatively, the battle game may involve spinning top toys 1 and 1 that spin counterclockwise in top view.

Alternatively, the battle game may involve a spinning top toy 1 that spins clockwise in top view and another spinning top toy 1 that spins counterclockwise in top view.

In such a case, the body 40 turns relative to the shaft portion 10 from the decouplable state to the couplable state due to the collision force and friction of the spinning top toys 1 and 1. In other words, the shaft portion 10 and the body 40 turn to firmly engage with each other. Thus, the spinning top toy 1 cannot be readily disassembled by a collision force or friction in some cases. In such a case, the win or loss of the game can be based on knocking out of the spinning top toy 1 of the opponent. It should be noted that the battle game can involve three or more spinning top toys 1.

The present invention can be suitably applied to manufacturing of spinning top toys.

The invention claimed is:

1. A spinning top toy having an axis of rotation, comprising:

a shaft portion having:

an upper portion having a flange at the lower end of the upper portion and an outer cylindrical segment that is fixed on the flange, extends upward along the axis and has first projections in a circumference of the upper portion;

a lower portion with a tip thereon upon which the top toy spins;

an inner column that is elongated along the axis inside the outer cylindrical segment, is fixed between the upper and lower portions of the shaft portion and has second projections that extend outward perpendicularly to the axis at an upper end of the inner column;

a movable cylindrical segment that has an upper surface and that moves along the axis, and along an outside of the fixed inner column; and a biasing member outside of the fixed inner column that applies a biasing force against the movable cylindrical segment in a first direction along the axis that is opposite to the tip, a body, separate from the shaft portion, having an upper portion, a cylindrical lower portion and third projections extending from the cylindrical lower portion of the body inwardly and perpendicularly to the axis, wherein the upper portion of the body has an arcuate slit therethrough, and wherein each of the third projections has a flat upper surface that can contact a lower surface of one of the second projections of the shaft portion, an adjuster ring, separate from and between the body and the shaft portion, having a central hole into which the outer cylindrical segment of the shaft portion can be inserted, depressions that can receive the first projections of the shaft portion and a fourth projection that extends upward and that can move in the arcuate slit of the body, wherein the third projections are positioned on the body such that:

(i) the second projections of the shaft portion and the third projections of the body do not align vertically in a first state where the outer cylindrical segment of the shaft portion is inserted into the central hole of the adjuster ring, the depressions of the adjuster ring being positioned respectively above the first projections of the shaft portion, and where the fourth projection of the adjuster ring is inserted into a first end of the arcuate slit of the body; and (ii) the second projections and the third projections align vertically in a second state where the depressions are positioned respectively above the first projections and where the fourth projection is inserted into a second end of the arcuate slit, wherein, when the body in the first state is pushed against the biasing force of the biasing member in a second direction along the axis toward the tip to push down the movable cylindrical segment, the top toy is put into the second state where:

(i) the third projections of the body are lower than the second projections of the shaft portion; and (ii) the depressions of the adjuster ring respectively house the first projections of the shaft portion to prevent the adjuster ring from turning relative to the shaft portion, wherein, when the body in the second state is turned relative to the shaft portion and the adjuster ring until the fourth projection of the adjuster ring comes to the second end of the arcuate slit, the second projections and the third projections align vertically, and the upper surfaces of the third projections are respectively engaged with the lower surfaces of the second projections by the biasing force of the biasing member, so that the shaft portion, the adjuster ring and the body are connected to each other.

2. The spinning top toy according to claim 1, wherein the second projections are a pair of the second projections located on opposing sides of the axis, and the third projections are a pair of the third projections located on opposing sides of the axis.

3. The spinning top toy according to claim 2, wherein the fourth projection is a pair of fourth projections located on opposing sides of the axis, and the arcuate slit is a pair of arcuate slits located on opposing sides of the axis.

4. The spinning top toy according to claim 2, wherein the adjuster ring is a fly wheel.

5. The spinning top toy according to claim 1, wherein the fourth projection is a pair of fourth projections located on opposing sides of the axis, and the arcuate slit is a pair of arcuate slits located on opposing sides of the axis.

6. The spinning top toy according to claim 5, wherein the adjuster ring is a fly wheel.

7. The spinning top toy according to claim 1, wherein the adjuster ring is a fly wheel.

* * * * *